US006575534B2

(12) United States Patent
Chen

(10) Patent No.: US 6,575,534 B2
(45) Date of Patent: Jun. 10, 2003

(54) ROD TYPE FOLDABLE FURNITURE

(76) Inventor: Gao-Shen Chen, 58, Ma Yuan West St., Taichung (TW)

( * ) Notice: Subject to any disclaimer, the term of this patent is extended or adjusted under 35 U.S.C. 154(b) by 28 days.

(21) Appl. No.: 09/897,836

(22) Filed: Jun. 28, 2001

(65) Prior Publication Data

US 2002/0124519 A1 Sep. 12, 2002

(30) Foreign Application Priority Data

Aug. 24, 2000 (TW) ..... 089214572 U

(51) Int. Cl.[7] ..... A47C 5/04

(52) U.S. Cl. ..... 297/411.43; 297/16.2; 297/41; 403/324

(58) Field of Search ..... 297/16.2, 35, 36, 297/411.43, 410; 403/49, 324, 378, 379.1

(56) References Cited

U.S. PATENT DOCUMENTS 2,974,965 A * 3/1961 Welles, Jr. ..... 294/82.35
4,483,638 A * 11/1984 Marie et al. ..... 403/1
4,604,777 A * 8/1986 Meeks ..... 279/83
5,472,254 A * 12/1995 Wander ..... 294/82.35
5,823,623 A * 10/1998 Beck ..... 403/20
5,860,703 A * 1/1999 Courtois et al. ..... 403/324
6,042,202 A * 3/2000 Goppion ..... 292/302
6,062,645 A * 5/2000 Russell ..... 403/324
6,076,436 A * 6/2000 Farley ..... 279/83
6,099,077 A * 8/2000 Isaacson ..... 294/82.35
6,149,238 A * 11/2000 Tsai ..... 297/188.14

FOREIGN PATENT DOCUMENTS

DE 3437803 A1 * 6/1986 ..... B60N/1/00
DE 4222921 A1 * 1/1994 ..... B60N/2/48

* cited by examiner

*Primary Examiner*—Peter M. Cuomo
*Assistant Examiner*—Stephen D'Adamo

(57) ABSTRACT

The present invention relates to a furniture including multiple rods, wherein a first rod has a first end rotated about a support shaft, and a second end formed with a first rod end corresponding to a second rod end of a second rod. A positioning base mounted on the second rod end has a locking groove. A fitting base mounted on the first rod end defines a receiving chamber having a wall formed with an opening. A locking base has a locking plate extended into the receiving chamber through the opening. The locking plate is formed with a locking hole. Two elastic member are mounted between the fitting base and the locking base, so that the locking base is normally moved outward. A retaining device may mount the locking base on the fitting base, so that the locking base may move toward the receiving chamber after being assembled.

5 Claims, 5 Drawing Sheets

ROD TYPE FOLDABLE FURNITURE

BACKGROUND OF THE INVENTION

1. Field of the Invention

The present invention relates to a rod type foldable furniture, and more particularly to rod type foldable furniture, wherein the connecting rods of the furniture may be assembled rigidly and stably.

2. Description of the Related Art

The closest prior art of which the applicant is aware is disclosed in the Taiwanese Patent application No. 88209218, entitled by "FOLDABLE CHAIR", which discloses a rod type foldable furniture including connectors, metallic rods and cloth assembled with each other.

Another closest prior art of which the applicant is aware is disclosed in the Taiwanese Patent application No. 86219023, entitled by "OUTDOOR ARTICLE PLACING RACK", which discloses a rod type foldable furniture consisting of connectors, and multiple metallic rods assembled with each other, thereby forming a table for placing articles.

Another closest prior art of which the applicant is aware is disclosed in the Taiwanese Patent application No. 87201698, entitled by "SKELETON CONNECTOR STRUCTURE OF AN OUTDOOR SLEEPING BED", which discloses a rod type foldable furniture consisting of multiple metallic rods assembled with each other.

The above-mentioned rod type foldable furniture can be folded and stored conveniently, thereby enhancing the versatility thereof.

SUMMARY OF THE INVENTION

The primary objective of the present invention is to provide a rod type foldable furniture, wherein the connecting rods of the furniture may be assembled rigidly and stably.

Another objective of the present invention is to provide a rod type foldable furniture having a locking effect, thereby facilitating combination of the parts of the furniture.

In accordance with the present invention, there is provided a rod type foldable furniture comprising multiple rods assembled with each other, wherein, a first rod has a first end that may be rotated about a support shaft, and a second end formed with a first rod end, the first rod end may be correspondingly mounted on a second rod end of a second rod, the furniture further comprises:

a positioning base, combined on the second rod end of the second rod, and having a locking groove;

a fitting base, combined on the first rod end of the first rod, and having a receiving chamber directed toward the positioning base, the receiving chamber having a housing wall formed with an opening communicating with the receiving chamber;

a locking base, inserted into the opening of the fitting base, and having a locking plate that may be extended into the receiving chamber, the locking plate formed with a locking hole for passage of the positioning base;

at least one elastic member, mounted between the housing wall of the fitting base and the locking base, so that the locking base is normally moved outward; and a retaining device, for mounting the locking base on the fitting base, the locking base capable of moving toward the receiving chamber after being assembled.

Further benefits and advantages of the present invention will become apparent after a careful reading of the detailed description with appropriate reference to the accompanying drawings.

DETAILED DESCRIPTION OF THE INVENTION

Figure 1:
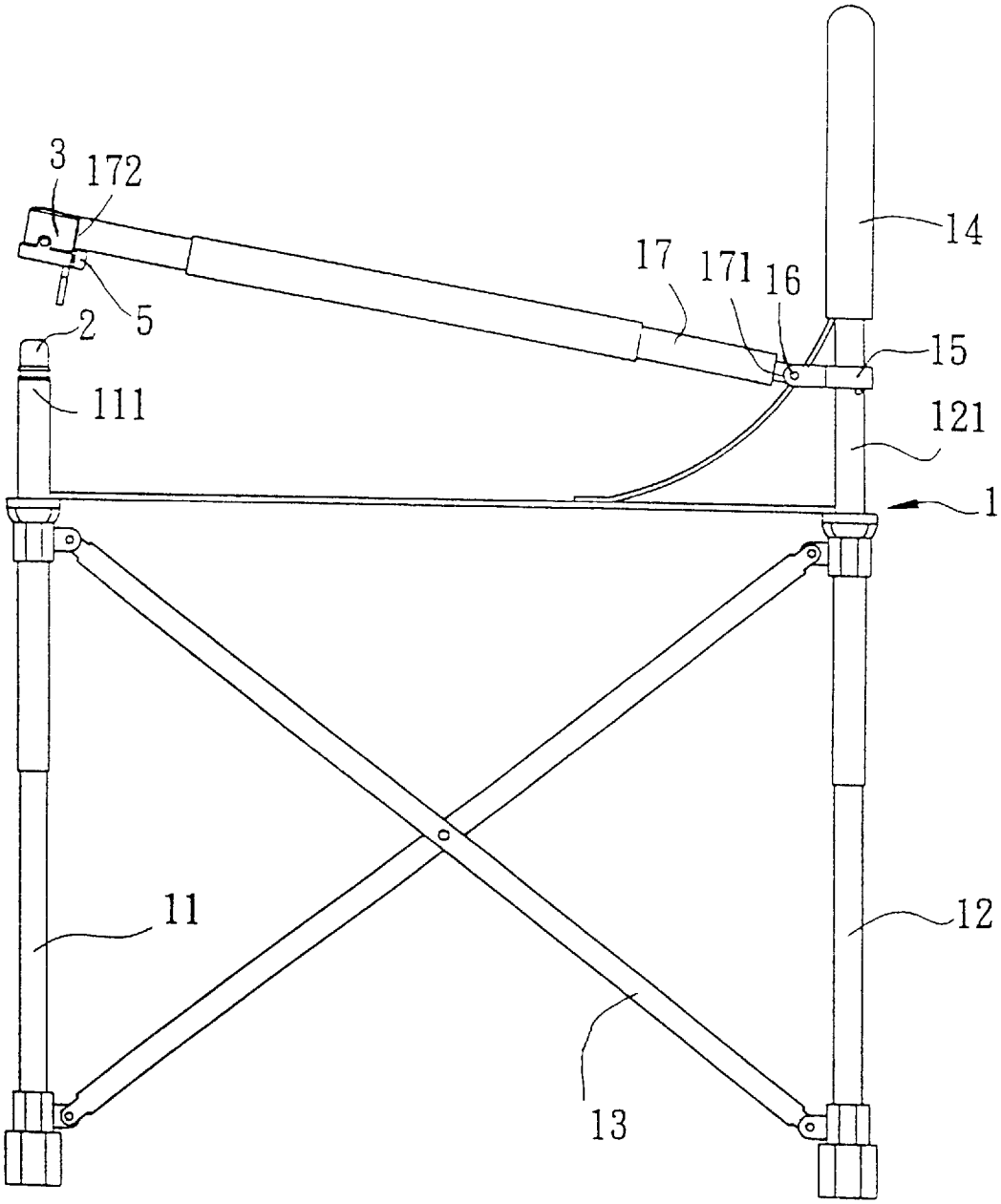
FIG. 1 is a side plan view of a rod type foldable furniture in accordance with the present invention.

Referring to the drawings and initially to FIG. 1, a rod type foldable furniture 1 in accordance with the present invention comprises two front leg rods 11, two rear leg rods 12, and support frames 13 each mounted between the two front leg rods 11, between the two rear leg rods 12, and between the front leg rod 11 and the rear leg rod 12 that are located at the same side, thereby supporting the two front leg rods 11 and the two rear leg rods 12. Each rear leg rod 12 has a top end provided with a backrest section 121 extended upward. A seat cushion 14 is mounted on the two backrest sections 121 and the two front leg rods 11. A movable pivot base 15 is mounted on each of the two backrest sections 121 under the seat cushion 14. Each pivot base 15 is respectively assembled with an armrest rod 17 by a support shaft 16 which is inserted into a pivot end of the armrest rod 17. The other end of the armrest rod 17 is formed with a first rod end 172 which may be rotated about the support shaft 16 to a second rod end 111 of the front leg rod 11 at the same side. The first rod end 172 is fitted on the second rod end 111, thereby expanding the furniture.

Figure 2:
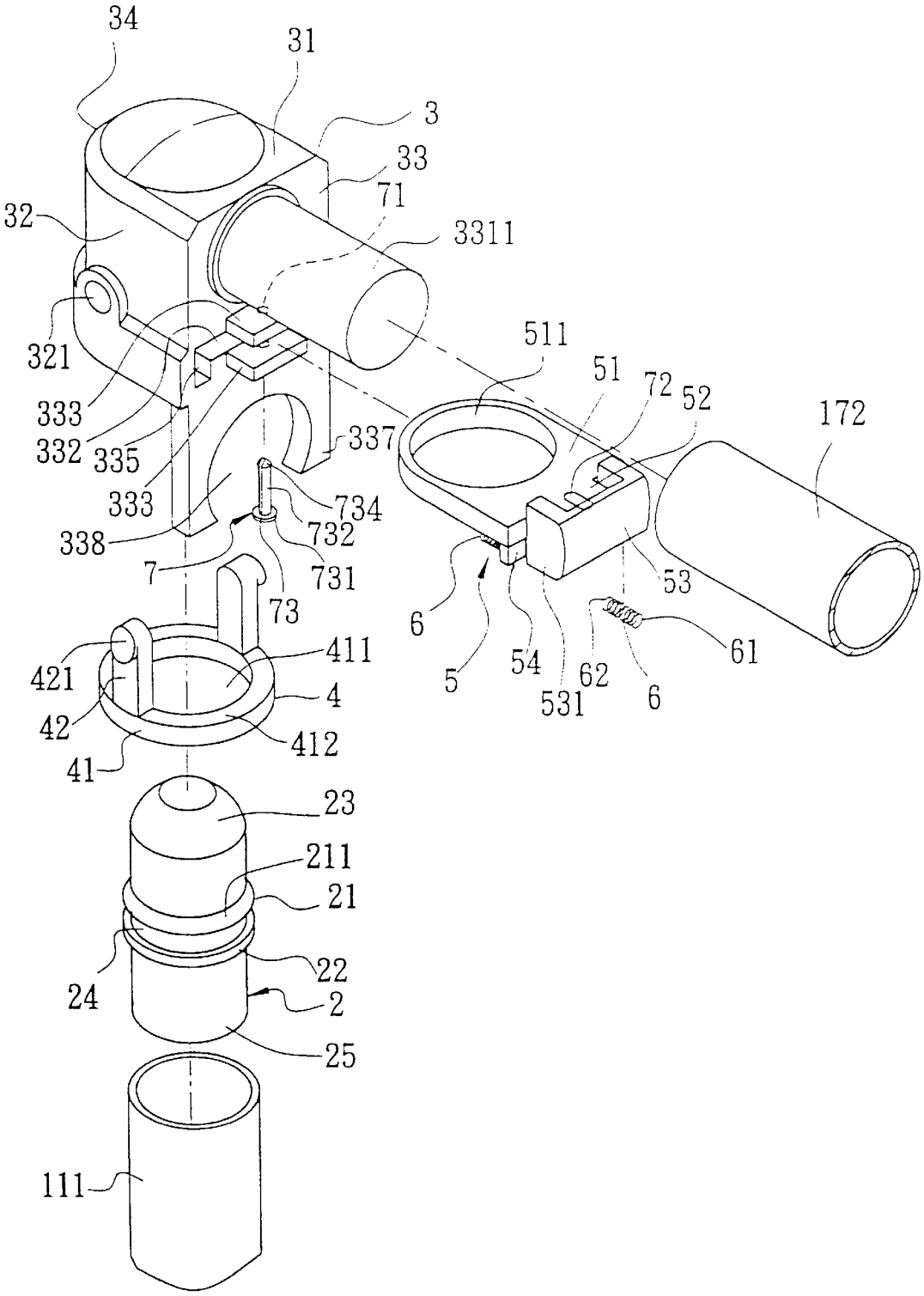
FIG. 2 is an exploded perspective view of the rod type foldable furniture in accordance with the present invention.
Figure 3:
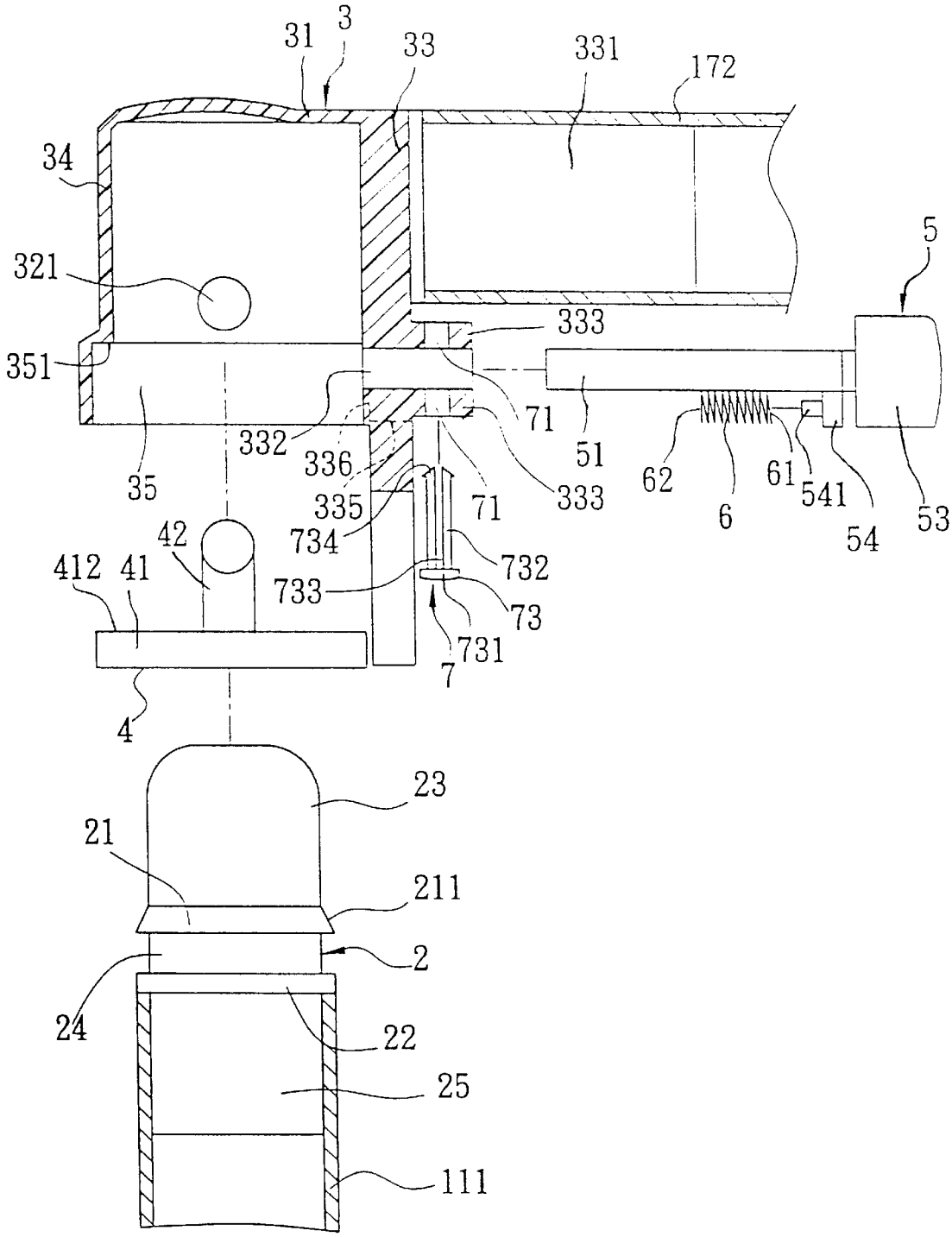
FIG. 3 is a side plan cross-sectional view of the rod type foldable furniture as shown in FIG. 2.

Referring to FIGS. 2 and 3, the second rod end 111 of each front leg rod 11 is respectively assembled with a positioning base 2. The first rod end 172 of each armrest rod 17 is assembled with a fitting base 3. Each fitting base 3 is provided with a holding base 4, a locking base 5, two elastic member 6, and a retaining device 7.

The positioning base 2 is a cylindrical base integrally formed by plastic material, and is formed with a locking ring 21 and a resting ring 22 under the locking ring 21, thereby respectively dividing the positioning base 2 into a protruding section 23 above the locking ring 21, a locking groove 24 between the locking ring 21 and the resting ring 22, and an insertion section 25 under the resting ring 22. The insertion section 25 may be secured in the second rod end 111 of each front leg rod 11, while the resting ring 22 is rested on the top of the second rod end 111 of each front leg rod 11. The locking ring 21 has an annular oblique face 211 whose diameter is gradually increased from top to bottom.

The fitting base 3 includes a top wall 31, two side walls 32, an arcuate front housing wall 34, and a rear housing wall 33 directed toward the first rod end 172. A circular receiving chamber 35 having an opening facing downward is formed in the fitting base 3. Each side wall 32 is formed with a positioning hole 321. An insertion section 331 is horizontally protruded from the rear housing wall 33, and may be secured in the first rod end 172. An opening 332 is formed in the rear housing wall 33 under the insertion section 331, and communicates with the receiving chamber 35. The upper edge and the lower edge of the opening 332 are respectively formed with a horizontally protruded wing plate 333. The lower wing plate 333 has a right side and a left side each respectively formed with a breach 335 extended downward. Each breach 335 has an upright catch plate 336 formed therein. The rear housing wall 33 has bottom end formed with a protruding plate 337 extended downward, thereby facilitating positioning the armrest rod 17 during the folding process. The protruding plate 337 defines a locking opening 338 facing downward. The receiving chamber 35 is formed with an upper shoulder 351.

The holding base 4 is locked in the receiving chamber 35 of the fitting base 3, and includes a fitting ring 41 which is flush with the bottom edge of the receiving chamber 35. The fitting ring 41 has a center defining a through hole 411 for passage of the protruding section 23 of the positioning base 2. The fitting ring 41 has top face formed with a lower shoulder 412 spaced from the upper shoulder 351. The lower shoulder 412 has a top protruded with two opposite locking hooks 42 each formed with a protruding tenon 421 protruded outward that may be inserted and locked into the positioning hole 321 of the fitting base 3.

The locking base 5 may be inserted into the opening 332 of the fitting base 3, and includes a locking plate 51 which may be inserted into the opening 332 of the fitting base 3 and located between the upper shoulder 351 and the lower shoulder 412. The locking plate 51 defines a locking hole 511 to allow passage of the locking ring 21. A connecting plate 52 having a shortened width is extended rearward from the rear side of the locking plate 51, and is parallel with the two wing plates 333 of the fitting base 3. An upright push plate 53 is protruded from the rear side of the connecting plate 52. The push plate 53 has two ends each formed with an enclosure 531 vertically extended forward. The distance between the two enclosures 531 is greater than the width of the wing plate 333. The locking plate 51 has a bottom having a rear portion having two sides each provided with a clip plate 54 vertically extending downward and corresponding to the breach 335. Each clip plate 54 has a front end protruded with a positioning stub 541.

Each elastic member 6 is a helical spring, and has two opposite end faces 61 and 62, wherein one end face 61 is mounted on the positioning stub 541, and the other end face 62 is rested on the catch plate 336 of the fitting base 3.

The retaining device 7 may mount the locking base 5 on the fitting base 3, so that the locking base 5 may be moved forward and backward on the fitting base 3. The retaining device 7 contains two pivot holes 71 each formed in the wing plate 333 of the fitting base 3, and an elongated slot 72 formed in the connecting plate 52 of the locking base 5 and aligning with the two pivot holes 71. The retaining device 7 includes an insertion pin 73 having a lower resting block 731 rested on a bottom of the lower wing plate 333, a protruding pin portion 732 mounted on the lower resting block 731 and extended through the two pivot holes 71 and the elongated slot 72, and an upper resting block 734 mounted on the top of the protruding pin portion 732 and rested on the upper wing plate 333. The protruding pin portion 732 is formed with a slit 733, so that the protruding pin portion 732 has an elasticity.

Figure 4:
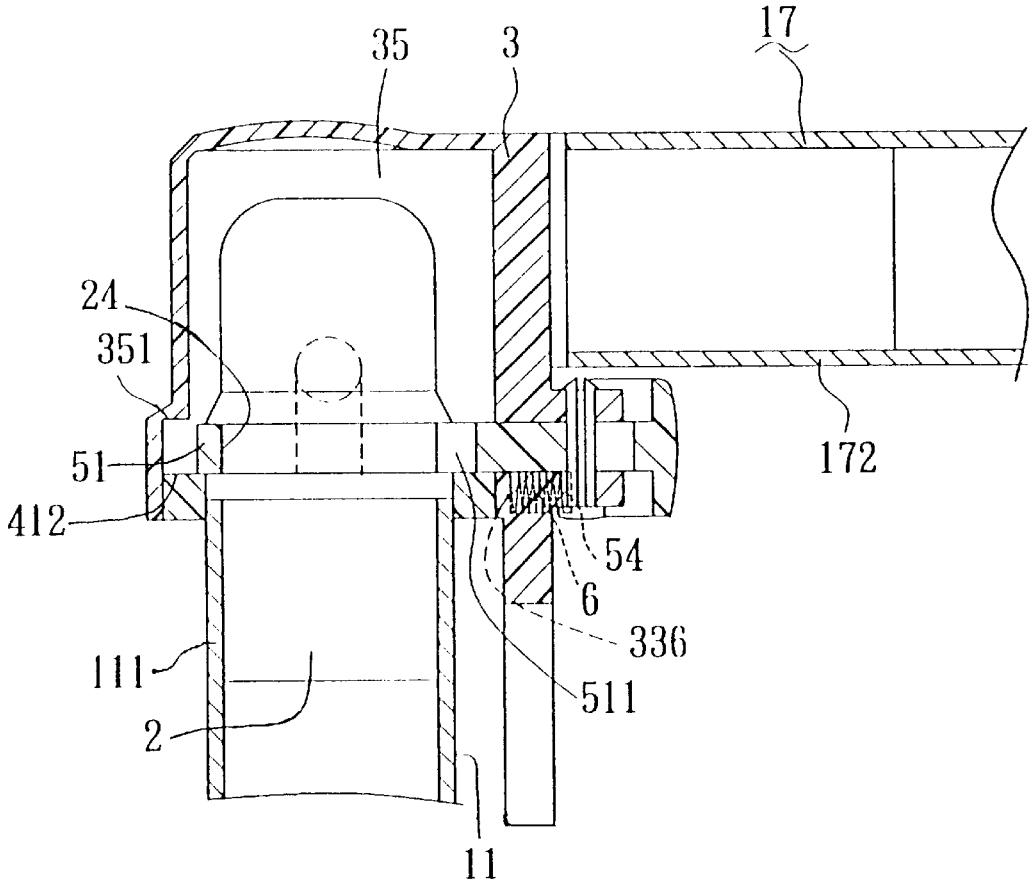
FIG. 4 is a side plan cross-sectional assembly view of the rod type foldable furniture as shown in FIG. 2.

Referring to FIGS. 2 and 4, the fitting base 3 mounted on the first rod end 172 of each armrest rod 17 is moved downward to be mounted on the positioning base 2 that is mounted on the second rod end 111 of each front leg rod 11. The locking groove 24 of the positioning base 2 is located between the upper shoulder 351 and the lower shoulder 412, so that the locking groove 24 of the positioning base 2 may be inserted into the locking hole 511 of the locking plate 51. At the same time, the two end faces 61 and 62 of each elastic member 6 are respectively rested between the catch plate 336 of the fitting base 3 and the clip plate 54 of the locking base 5, so that the elastic members 6 may push the locking base 5 to move outward. At this time, the wall of the locking hole 511 is locked in the locking groove 24 of the positioning base 2, so that the armrest rod 17 may be rigidly assembled with the front leg rod 11.

Figure 5:
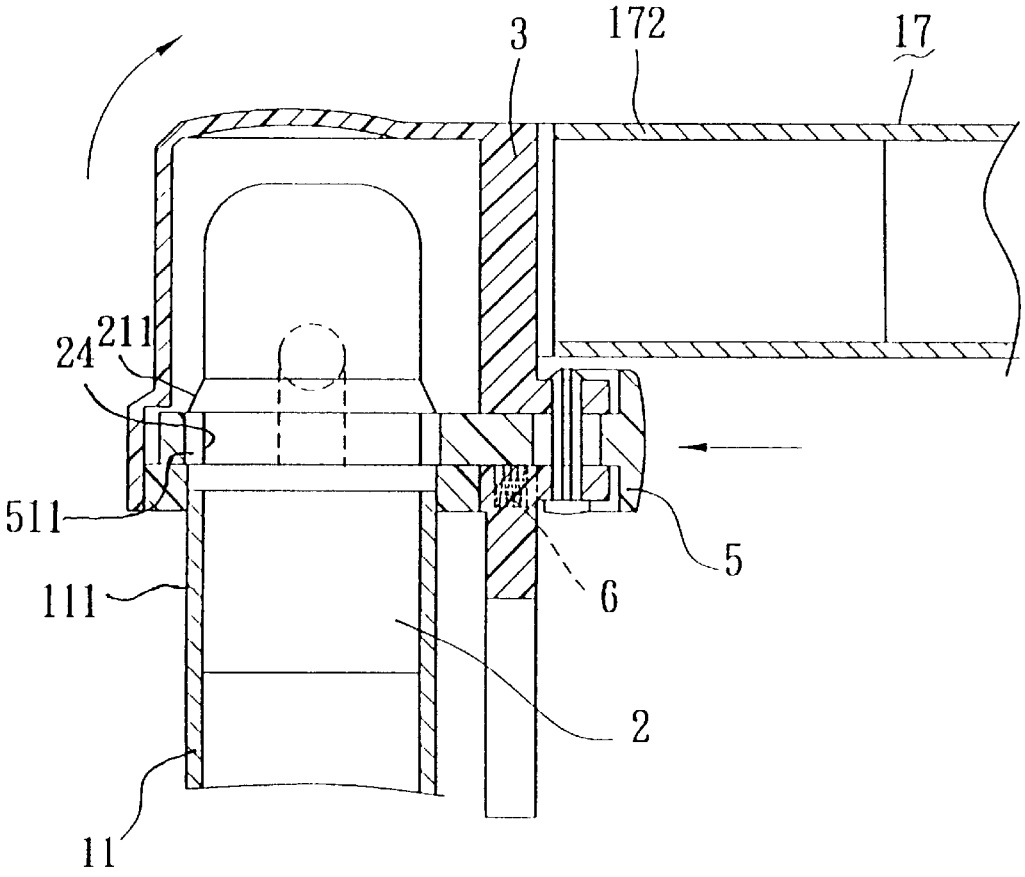
FIG. 5 is an operational view of the rod type foldable furniture as shown in FIG. 4.

Referring to FIGS. 1 and 5, the push plate 53 may be pushed to move the locking base 5 forward until the locking hole 51 aligns with the positioning base 2, so that the positioning base 2 may be detached from the locking base 5. The armrest rod 17 can then be pulled upward to pivot about the support shaft 16, thereby detaching the armrest rod 17 from the front leg rod 11, so that the front leg rods 11 and the rear leg rods 12 can be folded.

When the first rod end 172 of each armrest rod 17 is to be mounted on the second rod end 111 of the respective front leg rod 11, the first rod end 172 of each armrest rod 17 may be pivoted downward. When the bottom of the locking base 5 is rested on the annular oblique face 211 of the positioning base 2, the fitting base 3 may be pressed downward, so that the locking base 5 may gradually overcome the elasticity of the elastic members 6 to move forward. When the locking hole 51 aligns with the locking groove 24 of the positioning base 2, the locking base 5 may be moved backward by the restoring force of the elastic members 6, to return to the state as shown in FIG. 4.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A rod type foldable furniture comprising multiple rods assembled with each other, wherein, a first rod has a first end that is rotated about a support shaft, and a second end formed with a first rod end, the first rod end is correspondingly mounted on a second rod end of a second rod, the furniture further comprises:

a positioning base, combined on the second rod end of the second rod, and having a locking groove;

a fitting base, combined on the first rod end of the first rod, and having a receiving chamber directed toward the positioning base, the receiving chamber having a housing wall formed with an opening communicating with the receiving chamber;

a locking base, inserted into the opening of the fitting base, and having a locking plate extended into the receiving chamber, the locking plate being formed with a locking hole for passage of the positioning base;

at least one elastic member, mounted between the housing wall of the fitting base and the locking base, so that the locking base is normally moved outward; and a retaining device, for mounting the locking base on the fitting base, the locking base being capable of moving toward the receiving chamber after being assembled; wherein:

the opening of the fitting base has a periphery having two opposite wing plates, the locking plate of the locking base is formed with a connecting plate corresponding to the two wing plates, and the retaining device includes two pivot holes each formed in the wing plate of the fitting base, an elongated slot formed in the connecting plate of the locking base and aligning with the two pivot holes, and an insertion pin extended through the two pivot holes and the elongated slot.

2. The rod type foldable furniture in accordance with claim 1, wherein the positioning base is formed with a locking ring located above the locking groove, the locking ring has an annular oblique face whose diameter is gradually increased from a top to a bottom.

3. The rod type foldable furniture in accordance with claim 1, wherein the fitting base has a lower wing plate formed with two opposite breaches each containing an upright catch plate therein, the locking plate of the locking base has a bottom provided with two clip plates each corresponding to the catch plate, and the elastic member has two end faces respectively rested on the catch plate and the clip plate.

4. The rod type foldable furniture in accordance with claim 1, wherein the fitting base has two side walls each formed with a positioning hole, a holding base is mounted in a bottom of the receiving chamber of the fitting base, the holding base has a fitting ring, and two locking hooks each extended from the fitting ring toward the fitting base, each locking hook is formed with a protruding tenon that may be secured in the positioning hole of the fitting base.

5. The rod type foldable furniture in accordance with claim 1, wherein the positioning base has an insertion section inserted into the second rod end of the second rod, and the housing wall of the fitting base is protruded with an insertion section inserted into the first rod end of the first rod.

* * * * *